United States Patent [19]

Tichenor et al.

[11] 4,187,534

[45] Feb. 5, 1980

[54] UNIVERSAL LENS MOUNTING FOR SELECTIVE SPOTLIGHT BEAM SPREAD

[75] Inventors: Clyde L. Tichenor, Van Nuys; Craig LeVasseur, Calabasas, both of Calif.

[73] Assignee: Berkey-Colortran, Inc., Burbank, Calif.

[21] Appl. No.: 958,610

[22] Filed: Nov. 8, 1978

Related U.S. Application Data

[63] Continuation of Ser. No. 739,694, Nov. 8, 1976, abandoned.

[51] Int. Cl.[2] ..... F21Y 13/04

[52] U.S. Cl. ..... 362/268; 362/362; 362/455

[58] Field of Search ..... 362/268, 373, 455, 804, 362/362, 368, 1, 331, 365

[56] References Cited

U.S. PATENT DOCUMENTS

| | | | |
|---|---|---|---|
| 1,263,634 | 4/1918 | Hanson | 240/41.15 |
| 2,098,990 | 11/1967 | Newton | 240/41.15 |
| 2,114,963 | 4/1938 | Levy | 362/268 X |
| 2,497,147 | 2/1950 | Washam | 362/455 X |
| 2,650,292 | 8/1953 | Strong | 240/3 |
| 3,116,022 | 12/1963 | Davis | 240/3 |

*Primary Examiner*—Peter A. Nelson

*Attorney, Agent, or Firm*—Neuman, Williams, Anderson & Olson

[57] ABSTRACT

A lens casting or housing provides a series of grooves for selective mounting of various lenses to achieve various beam spreads. By spacing lenses in the housing, it is possible to reduce the diameter and thickness of the lens nearer the light source with consequent improvement in thermal characteristics as well as efficiency in light transmission.

10 Claims, 3 Drawing Figures

UNIVERSAL LENS MOUNTING FOR SELECTIVE SPOTLIGHT BEAM SPREAD

This is a continuation of application Ser. No. 739,694 filed Nov. 8, 1976, and now abandoned.

FIELD OF INVENTION

This invention relates to stage luminaires, and particularly to the design of spotlights for selection of beam spread characteristics.

BACKGROUND OF THE INVENTION

Various beam spreads are required for stage lighting. Zoom lenses are complicated, expensive and not free of maintenance problems. Known fixed lens systems do not take advantage of the best optical combinations to project the maximum intensity of light. These known devices characteristically are designed so that metal patterns or masking shutters may be adjusted or inserted within the system so that their shadow edge is projected against a remote surface. Such known devices may include one simple plano-convex lens or two such lenses placed together with the plane sides on the outside. The two element system provides a shorter focal length than is possible with either lens individually, and, in fact, a shorter focal length than is possible with any single lens. The disadavantage with the two element system is that the light absorption is doubled, weight is high, and risk of fracture under thermal stress is great.

The primary object of this invention is to overcome these disadvantages and to provide a versatile lens casting or housing capable of providing various beam widths by different simple combinations of lenses.

SUMMARY OF INVENTION

In order to achieve the foregoing objective, we provide a two element system in which the inner lens is spaced rearwardly and reduced in diameter to be just large enough to allow the imaging aperture fully to illuminate the surface of the outer lens surface. The reduced thickness and reduced mass of the inner lens allows the inner lens to take more thermal stress. Various beam spreads can be provided by a multiplicity of fixed predetermined holding positions for the two lenses. Field stops conveniently located at an unused lens position reduces aberrations to provide acceptable remote imaging notwithstanding the simple optical arrangement.

BRIEF DESCRIPTION OF DRAWINGS

A detailed description of the invention will be made with reference to the accompanying drawings wherein like numerals designate corresponding parts in the several figures. These drawings, unless described as diagrammatic or unless otherwise indicated, are to scale.

DESCRIPTION OF PRIOR ART LENS SYSTEM

Figure 1:
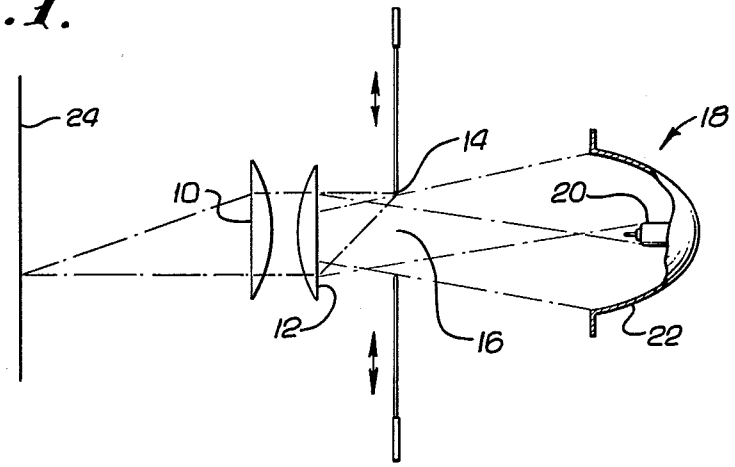
FIG. 1 is a diagrammatic axial sectional view of a typical prior art lens system.

In FIG. 1 there is shown a lens system for a compact spotlight designed to carry lenses up to, say, six inches in diameter. Two identical plano-convex lenses 10 and 12, each six inches in diameter, provide in combination of focal length of, say, four and a half inches for a wide angle beam of, say, 40°. A shutter edge 14 is positioned in the plane of the lens system focus 16. The edge allows passage of a beam of light from a source 18 that includes a lamp 20 and a reflector 22. The edge 14 is sharply imaged at a remote surface 24. The large lenses are thick, producing optical losses and creating hazards of breakage due to thermal stresses.

DETAILED DESCRIPTION OF PREFERRED EMBODIMENT

The following detailed description is of the best presently contemplated mode of carrying out the invention. This description is not to be taken in a limiting sense, but is made merely for purposes of illustrating the general principles of the invention since the scope of the invention is best defined by the appended claims.

Figure 2:
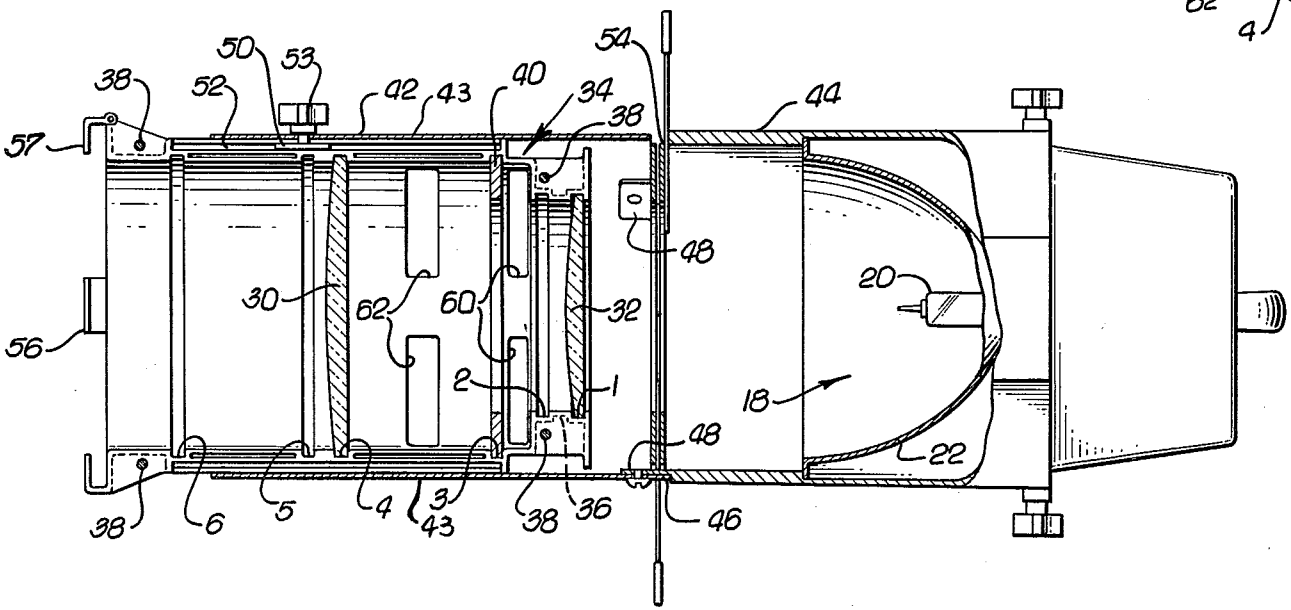
FIG. 2 is a side elevational view of a spotlight incorporating the present invention, part of the apparatus being broken away and shown in axial section.
Figure 3:
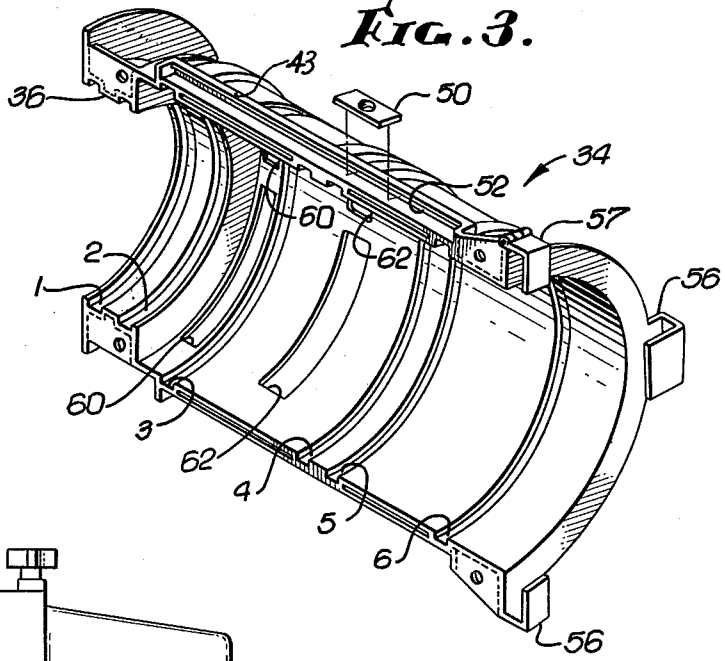
FIG. 3 is a perspective view of one of the symmetrical halves of the lens housing.

In FIG. 2, two lenses 30 and 32 are shown that are optically similar to the lenses 10 and 12 of the prior art system in that, in combination, they produce a short focal length of, say, four and a half inches for a wide angle beam of, say, 40°. The inner lens 32, however, is spaced rearwardly of its companion lens 30. Accordingly, while it is reduced in diameter, the inner lens 32 yet illuminates the entire area of its companion outer lens 30. The reduced diameter results in a lesser thickness and lesser mass, lessening optical losses and improving toleration for thermal stress.

In order to mount the lenses 30 and 32, a housing 34 is provided that is generally cylindrical in its main body portion. The housing 34 has a reduced neck 36 at its rear end. The housing is made of two identical lightweight castings, each an axial half, the halves being held together by screws 38.

The housing has a series of internal grooves 1, 2, 3, 4, 5 and 6, two located in the narrow neck 36 and four located in the main body portion of the housing 34. In the example illustrated in FIG. 2, the small lens 32 is located in the first groove 1 and its companion lens 30 is located in the fourth groove 4. A field stop 40 is conveniently accommodated in a groove 3 between the lenses that in another instance serves as a lens mounting groove.

In a well understood manner, the stop 40 has a circular aperture to confine the beam diameter between the lenses in order to limit aberrations. The plane surfaces of both lenses face rearwardly.

A substantial amount of heat is generated by the lamp 20. The housing 34 conducts heat from the lenses and in turn is cooled by the ambient air. A cylindrical shroud 42 surrounds the housing to protect the user from an uncomfortably hot structure. The housing is supported in the shroud 42 by four substantially equiangularly spaced peripheral fins or ribs 43 that frictionally fit the interior of the shroud. The fins or ribs 43 are deliberately designed to allow a negative clearance with respect to the interior of the cylindrical shroud. If a negative clearance exists, the ribs 43 slightly stretch the shroud from a true cylindrical configuration. The shroud is sufficiently thin to allow its flexure. By this design, manufacturing tolerances can be relaxed. The fins or ribs 43 form four frontally opening air ducts to be described hereinafter.

The fins or ribs 43 can take any desired form. In the present instance, two of the ribs are formed at opposite sides of the housing at the parting plane. These two ribs are formed by companion rails on the housing halves respectively. The other two fins or ribs (not shown) are located at the centers of the corresponding housing halves.

The shroud is fastened to the frontal end of a reflector housing 44. For this purpose, the shroud and the reflector housing each have companion overlapping ears or tabs 46 and 48 connected together. The lens housing 34 is secured in place at a longitudinally adjusted position by the aid of a clamp bar 50 that is slidably accommodated in grooves 52 formed beneath the ribs forming the supporting ribs or fins 43. The clamp bar is drawn tight by the aid of a screw 53 accessible at the top of the shroud. The clamp structure can readily be relocated at the bottom of the shroud.

Located between the shroud 40 and the reflector housing 44 are a series of pattern or image devices 54. The devices are located at the focal area of the lens system whereby the patterns are imaged at a remote focal plane.

The same hardware structure may be used to provide a spotlight of different beam angle. Only the lenses and field stops need be changed according to the following Table I:

| Field Angle | 1 | 2 | 3 | 4 | 5 | 6 |
|---|---|---|---|---|---|---|
| 40° | — | LENS 4.5 × 9 | LENS 6 × 9 | — | — | — |
| 30° | LENS 4.5 × 9 | — | FIELD STOP B | LENS 6 × 9 | — | — |
| 20° | — | FIELD STOP A | — | — | LENS 6 × 9 | — |
| 15° | — | FIELD STOP A | — | — | — | LENS 6 × 12 |

A-FIELD STOP IS 2.5 INCHES INSIDE DIAMETER.
B-FIELD STOP IS 3.75 INCHES INSIDE DIAMETER.
THE NOTATION 4.5 × 9 INDICATES 4.5" DIAMETER LENS AND 9" FOCAL LENGTH: 6 × 9 INDICATES 6" DIAMETER AND 9" FOCAL LENGTH: 6 × 12 INDICATES 6" DIAMETER AND 12" FOCAL LENGTH

In the narrow 15° beam mode, one relatively long focal length lens is used at the outermost groove together with a field stop. For a slightly wider 20° beam, a single shorter focal length lens is used at the next to outermost groove. For the 30° and 40° beams, two lenses are used in each case. One of the lenses is a larger diameter lens and the other a small diameter lens. The small diameter lens has a short focal length of, say, 4.5". A 30° beam is provided by locating the small lens relatively far from the larger diameter lens. In the last case of a 40° beam, the two lenses are located close together at grooves 2 and 3 respectively.

The casing halves provide ventilation openings for cooling. One pair of elongated openings 60 is provided in the small diameter parts of the housing. Another pair of elongated openings is provided in the peripheral wall of the large diameter housing part between grooves 3 and 4. These openings provide a path of air into the air ducts between the housing and the shroud for efficient cooling.

The casing halves also provide J-shaped holding brackets 56 for color frames, scrims, barn door base ring, or the like. Typically, there are three such brackets and a pivoted latch 57. Each casing half as cast provides a complete bracket at the center of the arc of the semi-cylindrical casting, and two half brackets at the parting plane of the housing. In practice, one set of companion half brackets are cut off in order to allow installation of the latch 57. By such fabrication technique, the housing parts as cast may be identical even though they later are mirror counterparts at the J-shaped brackets 56.

Intending to claim all novel, useful and unobvious features shown or described, I make the following claims:

1. In a stage lighting luminaire:

(a) a generally cylindrical lens housing having a small diameter rear end and a large diameter front end;

(b) said housing comprising two complementary halves separable along a longitudinal parting plane;

(c) said housing having a plurality of internal grooves in its large diameter end and a plurality of internal grooves in its small diameter end; said grooves being axially spaced from each other along the length of said housing;

(d) a set of lenses, including small diameter and large diameter lenses and selected for accommodation in said grooves for providing by optical combinations a beam of desired angular spread; and (e) means releasably securing said housing halves together releasably to lock the lenses in their selected grooves.

2. The stage lighting luminaire as set forth in claim 1 together with one or more field stops for use in combination with selected lenses, and accommodated in a selected groove of said housing.

3. The stage lighting luminaire as set forth in claim 1 together with one or more field stops used in the combinations of Table I.

4. The stage lighting luminaire as set forth in claim 1 in which each of said complementary halves has, at the front end of the housing, a substantially J-shaped holding bracket at the center of its arcuate wall and a half bracket at the said parting plane, said half brackets being located at mating ends of said arcuate walls to provide with said first mentioned brackets a three element receptor for a barn door ring, scrim, color frame, or the like.

5. In a stage luminaire:

(a) a generally cylindrical lens housing having a series of internal grooves for accommodating different optical combinations of lenses for selected beam spread;

(b) said housing having a series of substantially equiangularly spaced longitudinally extended peripheral ribs or fins;

(c) a reflector housing;

(d) a substantially cylindrical shroud for surrounding said lens housing, said ribs or fins engaging the interior of said shroud;

(e) said ribs or fins forming, with said shroud and said housing, a series of frontally opening air ducts;

(f) said housing having a series of openings conducting air from the interior of said housing to said air ducts; and (g) said shroud and said reflector housing having companion bracket means for securing said shroud to said reflector.

6. The luminaire as set forth in claim 5, in which at least one of said ribs or fins has a groove to accommodate a relatively slidable screw actuated clamp bar for releasably securing said housing in an axially adjusted position in said shroud.

7. The combination as set forth in claim 5 in which said shroud is made of thin flexible material whereby a negative clearance relationship between said shroud and said fins or ribs causes said shroud slightly to distort its cylindrical contour.

8. The luminaire as set forth in claim 5 together with movable pattern holders supported between said bracket means, said pattern holders being located between said reflector and said lens housing for projection by said lens system.

9. The luminaire as set forth in claim 5 in which said housing has a larger diameter part and a smaller diameter part, each part having a plurality of axially spaced grooves for accommodating lenses; and a set of lenses and field stops installed in preselected combinations in said housing grooves.

10. In a stage lighting luminaire:

(a) a generally cylindrical lens housing having a front and a rear end;

(b) said housing being generally separable into at least a plurality of parts;

(c) said housing having a plurality of internal grooves, each of said grooves having arcuate sections in each of said housing parts, said grooves being axially spaced from each other between said front and rear ends, said grooves being accessible for placement and edge mounting of lenses upon separation of said housing parts;

(d) one or more lenses selected for accommodation in at least one of said grooves for providing a light beam of desired angular spread; and (e) means selectively maintaining said housing parts in said generally cylindrical form to releasably secure one or more of said lenses in said selected grooves.

* * * * *